US005589675A

United States Patent [19]

Walters et al.

[11] Patent Number: 5,589,675

[45] Date of Patent: Dec. 31, 1996

[54] VACUUM SWITCH

[75] Inventors: Nole L. Walters, Granger, Ind.; Edward A. Raleigh, Madison, Wis.; Peter H. Thiel, Bloomington, Ind.

[73] Assignee: Trinetics, Inc., Mishawaka, Ind.

[21] Appl. No.: 224,819

[22] Filed: Apr. 8, 1994

[51] Int. Cl.[6] ..... H01H 33/02; H01H 33/66

[52] U.S. Cl. ..... 218/140; 218/154

[58] Field of Search ..... 218/118, 119, 218/120, 140, 138, 134, 153, 154, 2, 7, 14, 78, 84, 92, 57; 200/400, 401

[56] References Cited

U.S. PATENT DOCUMENTS

| | | | |
|---|---|---|---|
| 3,784,774 | 1/1974 | Wilson | 218/140 |
| 4,105,878 | 8/1978 | Date et al. | 218/14 X |
| 4,124,790 | 11/1978 | Kumbera et al. | 218/140 X |
| 4,283,610 | 8/1981 | Date et al. | 218/14 X |
| 4,591,679 | 5/1986 | Yamat et al. | 218/140 |
| 4,663,504 | 5/1987 | Barkan | 218/57 |
| 4,713,503 | 12/1987 | Kamp | 218/140 |

OTHER PUBLICATIONS

Joslyn, VerSaVac Brochure, Apr., 1990.

Cooper Power Systems, Oil and Vacuum–Break Switches Brochure, Jan., 1990.

General Electric, GE Arresters and Capacitors Brochure, 1993.

*Primary Examiner*—J. R. Scott

*Attorney, Agent, or Firm*—Barnes & Thornburg

[57] ABSTRACT

A vacuum switch includes a mechanism for opening and closing the contacts including a drive link, three toggle links and a drop link. The drive link is coupled to the movable contact of the vacuum bottle and to a mounting tower. The drive link is also coupled to two of the toggle links. The toggle links are coupled to the drop link, which is in turn coupled to a lever. A cam is coupled to the lever via a pin. The cam is also coupled to an over-center spring mechanism. A handle is used to rotate the pin to which the cam is coupled, which in turn rotates the cam. As the cam rotates, the spring mechanism prevents movement of the lever and various links until a predetermined amount of energy is stored in the spring. When this energy level is reached, the spring assembly pivots, thereby allowing the cam to pivot as well. The pivoting cam strikes the lever and causes it to move. The lever in turn imparts motion to the drive system via the drop link. The contacts may be opened or closed depending upon the direction of rotation of the handle.

22 Claims, 7 Drawing Sheets

VACUUM SWITCH

BACKGROUND AND SUMMARY OF THE INVENTION

The present invention relates to a medium voltage load switch for medium voltage power lines and, more particularly, to an improved mechanism for opening and closing the contacts of a vacuum insulated switch.

Medium voltage load switches are generally rated 60 to 600 amperes and operate at voltages of 15 through 38 KV. They are used to connect or disconnect capacitor banks, transformers and other loads and devices commonly used in power distribution. Medium voltage load switches presently on the market use different schemes to open and close their contacts in different types of insulating media such as air, oil, vacuum and sulfur hexaflouride. Typically, such a switch includes a covered tank filled with an insulating medium. A pair of terminals extends through the lid of the switch into the tank. The terminals are surrounded by porcelain bushings. A plurality of contacts is disposed within the insulating medium. At least one of the contacts is movable and at least one of the contacts is stationary. The terminals are electrically coupled to the contacts such that when the contacts are closed, electric current may flow from one terminal to the other. Conversely, when the contacts are open, the flow of current is interrupted. Thus, the switch may be used to cut power at a given location along a medium voltage power line to allow servicing of the equipment downstream from the switch. The insulating medium in such a switch performs two functions: It prevents restrikes during contact opening and closing and it suppresses arcing between the electrically energized parts and the grounded tank and cover.

Two types of contact systems for medium voltage load switches are known in the industry: Contact bar and vacuum bottle. A typical contact bar switch includes two pairs of stationary contacts and one movable contact bar submerged in an insulating oil. The contacts are fixed to an electrically nonconductive support. Each terminal is coupled to one of the stationary contacts. The contact bar is pivotally connected to the support on which the stationary contacts are mounted. In one prior art device, a rigid rod is pivotally connected at one end to the contact bar and at the other end to a lever. The lever is in turn pivotally secured about a pin. A cam is also secured about the same pin. The cam may be connected to an over-center spring assembly. The contact bar may be moved into contact with the stationary contacts by manually or automatically rotating the pin to which the cam and lever are secured. As the pin rotates, the cam rotates and compresses the spring of the over-center spring assembly. After a certain degree of compression of the spring has occurred, the energy stored in the spring assembly is such that it pivots rapidly, thereby causing the cam to rotate swiftly and strike the lever. When the cam strikes the lever, the lever pivots about the pin, thereby causing movement of the rigid rod. As the rod moves, the contact bar pivots into electrical contact with the stationary contacts. In this manner, electrical contact is made from one terminal to the other.

In the vacuum bottle type switch, a vacuum bottle having one movable contact and one stationary contact which are enclosed within a sealed vacuum chamber is placed in a porcelain bushing. Again, one terminal is electrically coupled to the movable contact and the other terminal is electrically coupled to the stationary contact. In one prior art embodiment of a vacuum bottle switch, the movable contact is coupled to a series of toggle links. One of the links is coupled to a push/pull type solenoid. Current is applied to the solenoid to move the toggle links, thereby opening or closing the contacts.

In both the contact bar and vacuum bottle switches, the contacts must be opened and closed rapidly to prevent restrikes of the current. In the contact bar switch, the insulating medium prevents restriking between the contacts as they are opened and closed, and further prevents arcing between the contacts and the tank. Vacuum around the contacts prevents restriking in the vacuum bottle switch, however, no oil is required in the tank to prevent arcing since the operating mechanism in the tank is at low voltage.

Although the foregoing prior art devices are generally suitable for their intended purposes, they have several drawbacks. First, with respect to the vacuum bottle system described above, the solenoid directly drives the toggle link system for opening and closing the contacts. Thus, the vacuum bottle system may be manually opened but cannot be manually closed. Although the contact bar switch may be operated either by motor or manually, such a switch has a much shorter life than a vacuum bottle type switch.

Accordingly, it is an object of the present invention to provide an improved medium voltage load switch.

Another object of the present invention is the provision of an improved mechanism for opening and closing the contacts of a medium voltage load switch.

Yet another object of the present invention is the provision of a medium voltage load switch which may be opened and closed manually or electrically.

Yet another object of the present invention is to increase the mechanical life of a vacuum bottle switch and insulate the electrically energized parts from the tank and cover.

These and other objects of the present invention are attained by a mechanism for opening and closing the contacts of a vacuum switch including a drive link coupled to a movable contact of the vacuum bottle. A first toggle link is coupled to the drive link and a drop link is coupled to the toggle link and to a lever. A cam is coupled to the lever for imparting motion to the lever. A handle is coupled to the cam for rotating the cam. The cam is also coupled to a spring assembly. The spring assembly resists movement of the movable contact until a predetermined level of force is stored in the spring assembly.

According to another embodiment of the present invention, a latch is provided for holding the contacts in the open position. The latch may abut the drop link, a pin on which the drop link rotates or rollers disposed abut such a pin, when the contacts are in the open position.

According to another embodiment of the present invention, a second toggle link is coupled to the first toggle link and to the drop link.

According to another embodiment of the present invention, a third toggle link is coupled to the drive, first, second and drop links.

According to yet another embodiment of the present invention, a mounting tower is disposed in the switch. The second toggle link and the drive link are coupled to the mounting tower.

In another embodiment of the present invention, a torsion spring is coupled to the drive link and an over travel spring is disposed above the movable contact.

In still another embodiment of the present invention, the spring assembly comprises a coil spring, a shaft having a first end and a second end extending through the spring, a first head fixed to the first end of the shaft and a second head having a bore therein for slidably receiving the second end of the shaft. The first head is pivotally secured to the cam and the second head is pivotally secured to a cover of the switch.

Other objects, advantages and novel features of the present invention will become apparent when considering the following detailed description of the preferred embodiments in conjunction with the accompanying drawings.

DETAILED DESCRIPTION OF THE PREFERRED EMBODIMENTS

Figure 1:
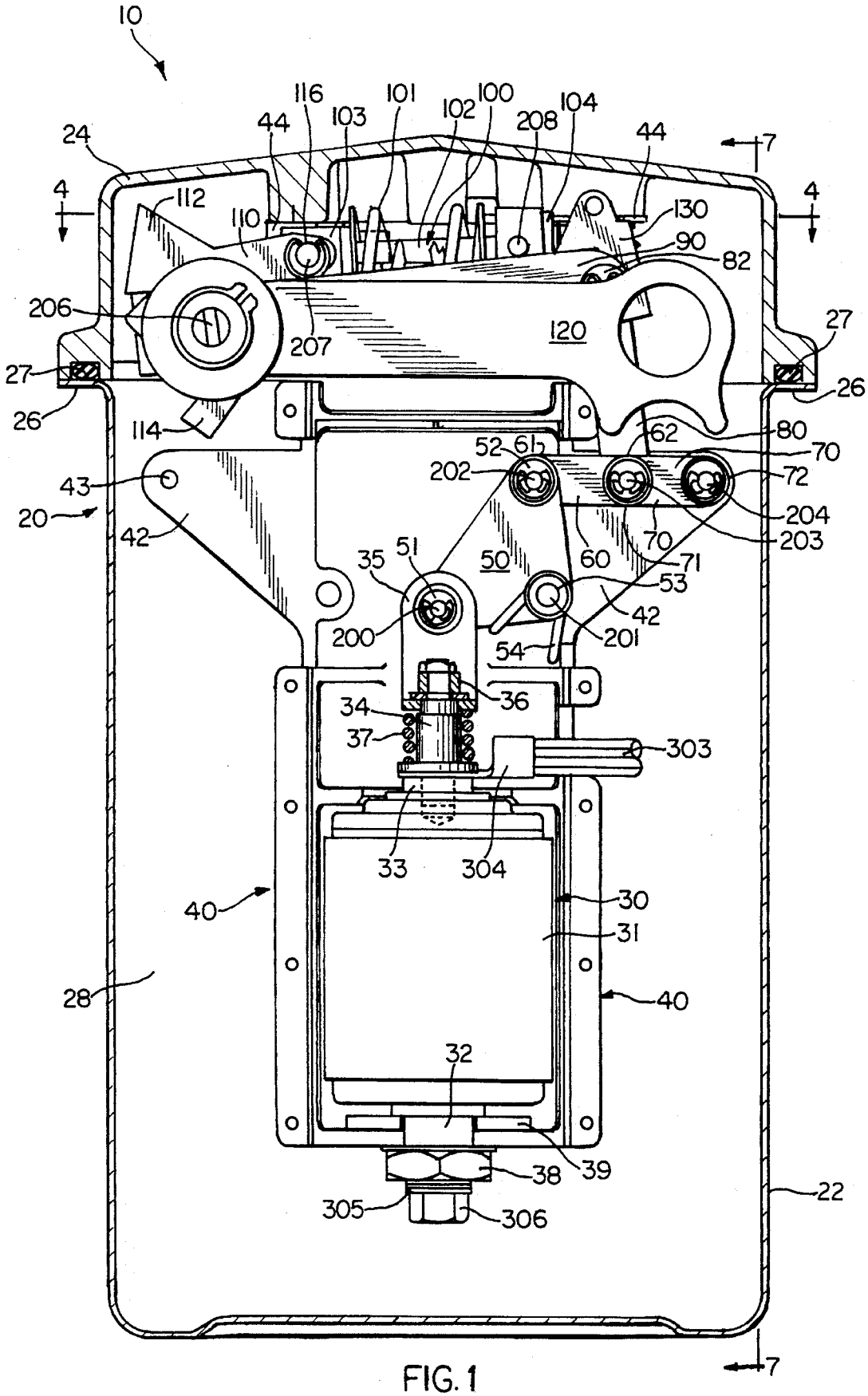
FIG. 1 is a cross-sectional view of a vacuum switch according to the present invention.

FIG. 1 shows a cross-sectional view of a vacuum switch 10 according to the present invention wherein the bushings and terminals have been removed. Switch 10 generally includes housing 20, vacuum bottle 30, mounting tower 40, drive link 50, left toggle links 60, right toggle link 70, drop link 80, lever 90, spring assembly 100, cam 110, handle 120 and latch 130.

Housing 20 generally includes tank 22 and lid 24. Tank 22 terminates at its open end in flange 26. Lid 24 is placed over flange 26 and bolted thereto so as to form a tight seal between tank 22 and lid 24. O-ring 27 is disposed about the perimeter of lid 24 to assist sealing.

Vacuum bottle 30 includes vacuum chamber 31, stationary contact 32 and movable contact 33. Both stationary contact 32 and movable contact 33 extend into vacuum chamber 31, where they may alternately be placed in contact with one another or separated to complete or break the path of current flow. The portion of movable contact 33 extending above vacuum bottle 30 includes a threaded opening. The portion of stationary contact 32 extending below vacuum bottle 30 includes a threaded opening and external threads. The vacuum in vacuum chamber 31 insulates stationary contact 32 and movable contact 33, thereby preventing restrikes. Stud 34 includes an externally threaded shaft and is coupled to movable contact 33 by screwing stud 34 into the threaded opening of movable contact 33. Stud 34 is secured to clevis 35 by nut 36. Over-travel spring 37 is disposed about stud 34 beneath clevis 35. A jam nut 38 is secured to the external threads of stationary contact 32 to secure vacuum bottle 30 in the tower 40, described below. Vacuum bottle 30 is supported on washer 39.

Figure 2:
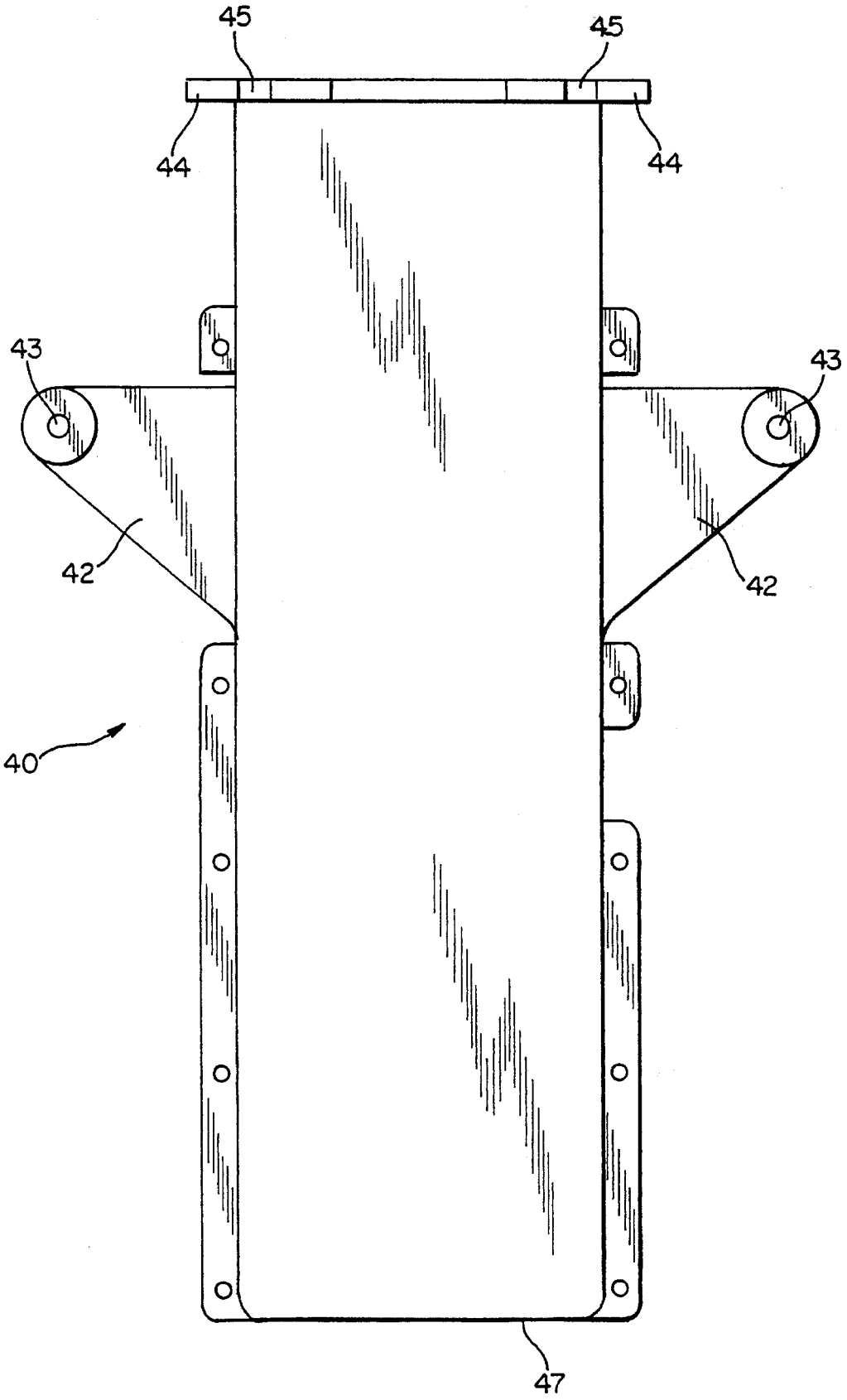
FIG. 2 is a side plan view of a mounting tower for use with a vacuum switch according to the present invention.
Figure 3:
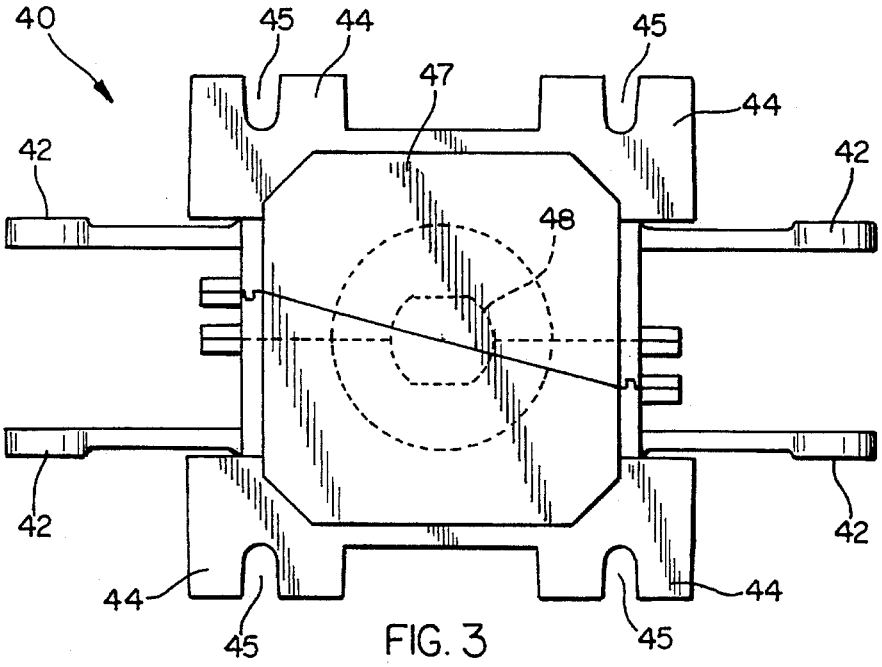
FIG. 3 is a top plan view of the mounting tower shown in FIG. 3.

Mounting tower 40 (FIGS. 2–3) is a generally elongated box-like structure comprising two halves. Each half has two ears 42 extending therefrom. Each ear 42 includes a hole 43. Tabs 44 are disposed at each corner of mounting tower 40. A slot 45 is provided in each tab 44. A pair of blind holes (not shown) is provided in mounting tower 40 adjacent ears 42. Bottom 47 of mounting tower 40 has a hole 48 therein.

Drive link 50 is a generally triangular member having a first pivot point 51, a second pivot point 52 and a third pivot point 53. A torsion spring 54 is disposed about third pivot point 53.

Left toggle links 60 are generally elongated members having first ends 61 and second ends 62. First ends 61 are coaxial with second pivot point 52 of drive link 50.

Right toggle link 70 is also a generally elongate member having a first end 71 and a second end 72. First end 71 is coaxial with second ends 62 of left toggle links 60.

Drop link 80 is a generally elongate member having a first end 81 and a second end 82. First end 81 is coaxial with second ends 62 of left toggle links 60 and first end 71 of right toggle link 70.

Lever 90 is a generally U-shaped member having two arms 91 joined by a bight 92.

Spring assembly 100 includes a coil spring 101 disposed about a shaft 102. A first head 103 is fixedly attached to one end of shaft 102. A second head 104 is disposed at the opposite end of shaft 102 and includes a bore 105 therein. Bore 105 is dimensioned so as to receive shaft 102 during operation of switch 10, as described below.

Cam 110 includes a first pair of arms 112 and a second pair of arms 114. Cam 110 further includes pivot point 116.

Handle 120 is a generally elongated member coupled to lever 90 and cam 110. Handle 120 may be used to open and close switch 10, as described below.

Latch 130 is pivotally secured to lid 24 of switch 10 and holds contact 33 in the open position, as described below.

Figure 4:
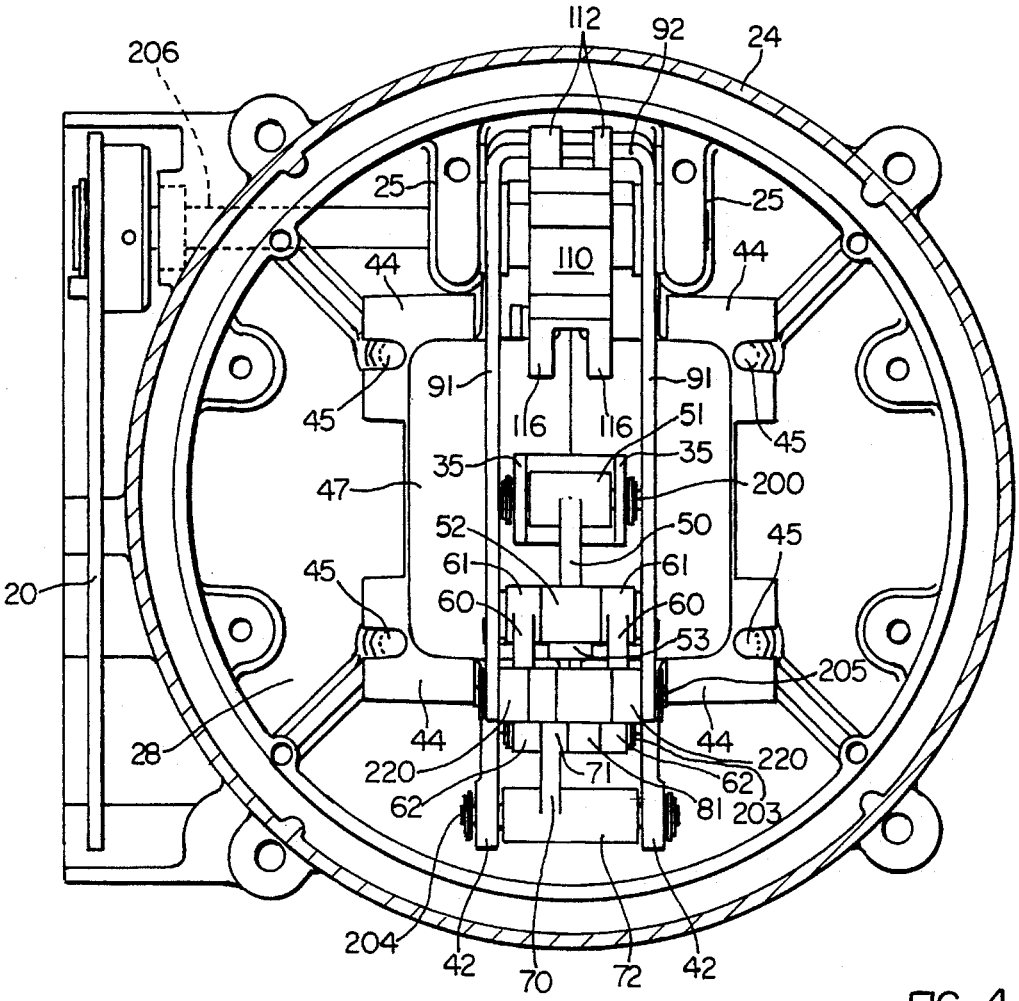
FIG. 4 is a cross-sectional view taken along line 4—4 in FIG. 1 with certain components removed to show the toggle linkage arrangement.

Switch 10 is assembled by inserting vacuum bottle 30 in mounting tower 40 such that support washer 39 rests on bottom 47 and the lower portion of stationary contact 32 extends through opening 48 in bottom 47. As described above, jam nut 38 is fastened to the external threads on stationary contact 32 to secure vacuum bottle 30 in mounting tower 40. The two halves of mounting tower 40 are secured by a plurality of screws or similar fasteners. Drive link 50 is secured to mounting bottle 30 by inserting a pin 200 through the arms of clevis 35 and through first pivot point 51. Drive link 50 is then secured to mounting tower 40 by inserting a second pin 201 in the blind holes 46 in mounting tower 40 and through third pivot point 53 of drive link 50. Torsion spring 54 is also disposed about pin 201. Second pivot point 52 of drive link 50 and first ends 61 of left toggle links 60 are then joined by a pin 202. Second ends 62 of left toggle links 60, first end 71 of right toggle link 70 and first end 81 of drop link 80 are then secured about a pin 203. Second end 72 of right toggle link 70 is secured to mounting tower 40 by inserting a pin 204 through holes 43 in ears 42 and through second end 72. Second end 82 of drop link 80 is coupled to the open end of lever 90 by a pin 205. A pair of rollers 220 are disposed about pin 205 on each side of end 82 of drop link 80. Rollers 220 reduce wear on pin 205 that would otherwise be caused by latch 130. The opposite end of lever 90 is secured to lid 24 by inserting a pin 206 through a pair of arms 25 in lid 24. This may best be seen in FIG. 4, in which spring assembly 100, latch 130 and the upper most portion of lid 24 have been removed for clarity. Can 110 is secured to pin 206 by a pin (not shown) such that cam 110 rotates with pin 206. Handle 120 is secured to pin 206 and may be used to rotate pin 206 to operate switch 10.

Pivot point 116 of cam 110 is secured to first head 103 of spring assembly 100 by means of a pin 207. Second head 104 of spring assembly 100 is pivotally secured to lid 24 of switch 10 by use of a pin 208 inserted through a pair of ears 26 secured to lid 24. Similarly, latch 130 is pivotally secured to lid 24. As noted above, handle 120 is secured to pin 206 so as to impart rotational motion to pin 206. Mounting tower 40 is secured to lid 24 by inserting bolts or similar fasteners through slots 45 in tabs 44 and into lid 24. Tank 20 is filled with oil to lubricate the drive system and insulate the electrically charged parts from the grounded tank and lid.

Figure 5:
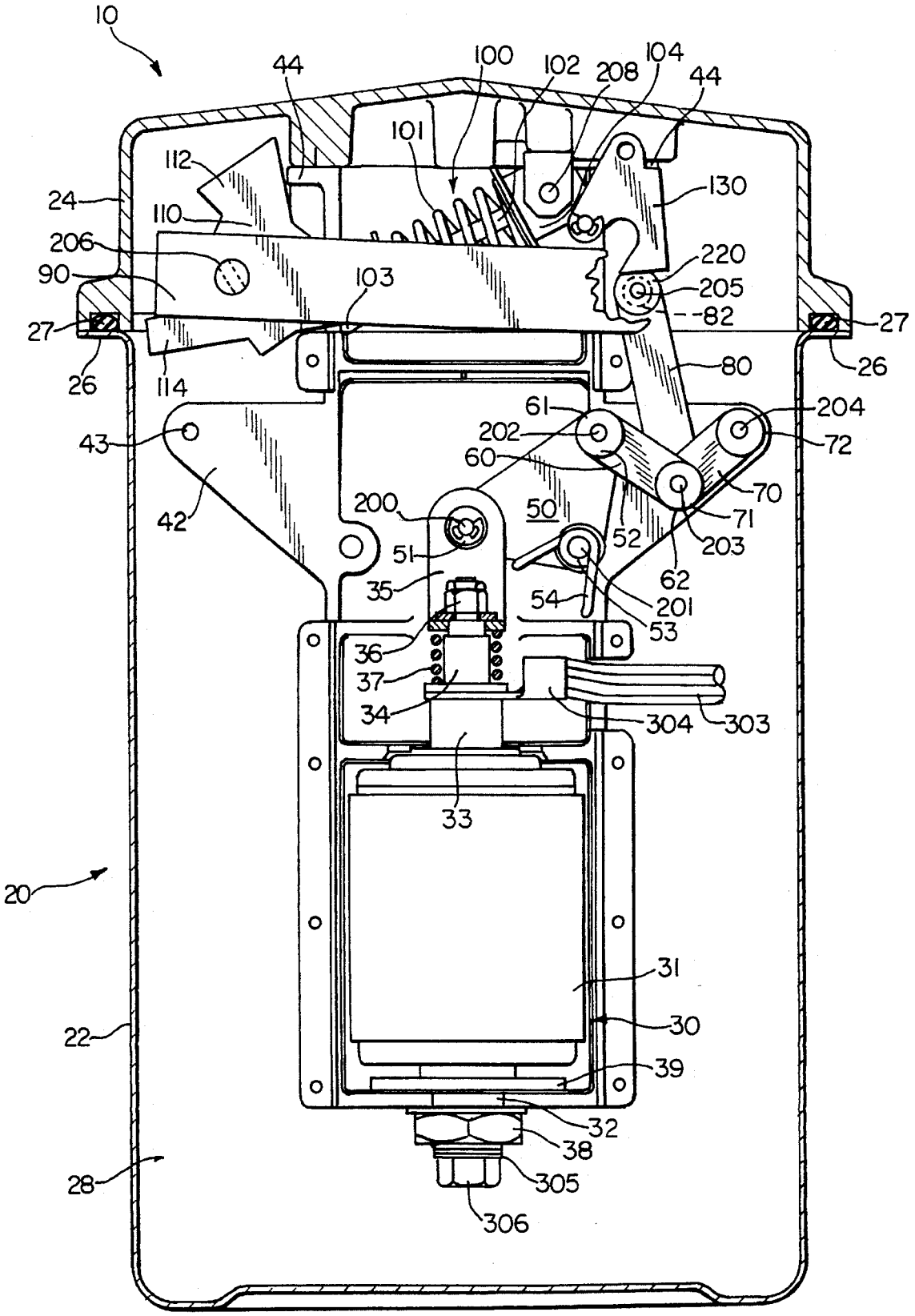
FIG. 5 is a partial cut-away view of the switch shown in FIG. 1 in the open position.
Figure 6:
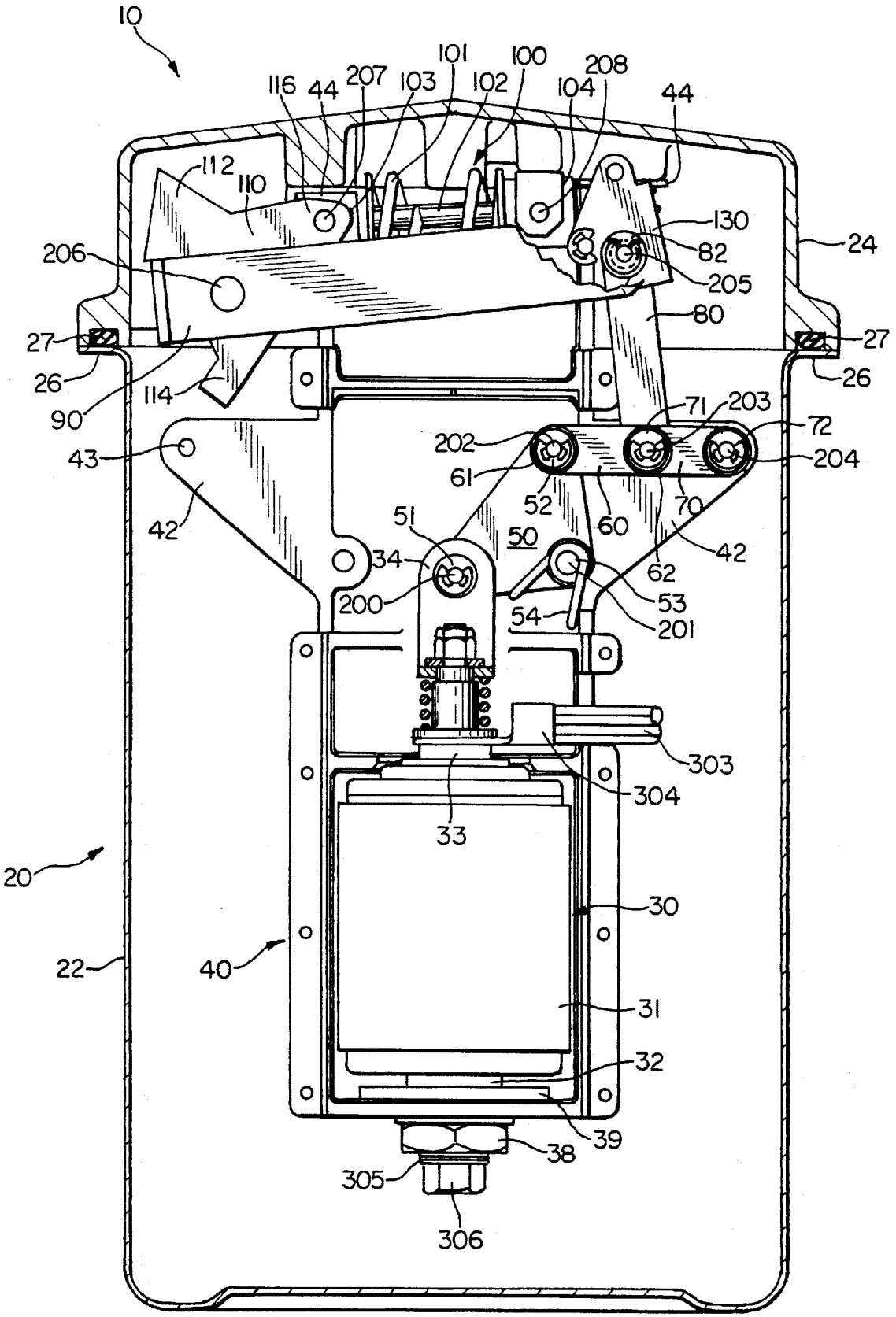
FIG. 6 is a partial cut-away view of the switch shown in FIG. 1 in the closed position.

FIG. 5 shows switch 10 in the open position with handle 120 removed and one arm 91 of lever 90 partially cut away. As shown in this figure, movable contact 33 of vacuum bottle 30 is raised inside vacuum chamber 31 so as not to make electrical contact with stationary contact 32. Because vacuum bottle 31 is at lower pressure than the atmosphere, the atmospheric pressure attempts to force movable contact 33 downward into the closed position. As this occurs, stud 34 and clevis 35 pull downwardly on first pivot point 51 of drive link 50. This causes second pivot point 52 and third pivot point 53 of drive link 50 to attempt to rotate in a counterclockwise direction. As drive link 50 attempts to rotate in a counterclockwise direction, first ends 61 of left toggle links 60 are pulled in the same direction. This action creates an upward force directed along the length of drop link 80 as second ends 62 of left toggle links 60 and first end 71 of right toggle link 70 attempt to rotate upwardly around pin 203. However, because latch 130 abuts roller 220 on pin 205, drop link 80 is prevented from moving in an upward direction and, therefore, prevents rotation of the entire drive system consisting of drive link 50, left toggle links 60, right toggle link 70 and drop link 80. Thus, the contacts of vacuum bottle 30 are held in the opened position against atmospheric pressure.

To close the contacts of vacuum bottle 30, handle 120 is pulled upward. As this occurs, pin 206 rotates in a counter-clockwise direction. Because cam 110 is secured to pin 206, it too rotates in a counter-clockwise direction. As cam 110 rotates, pivot point 116 rotates around pin 206 and applies force to second head 103 of spring assembly 100. Second head 103 in turn applies force to shaft 102 and spring 101. This force causes compression of spring 101 and causes shaft 102 to slide into bore 105 in second head 104. After a predetermined amount of rotation of cam 110 stores a predetermined amount of force in spring 101, second head 104 of spring assembly 100 pivots swiftly about pin 208 in a clockwise direction and strikes latch 130. As second head 104 strikes latch 130, latch 130 is knocked from its position abutting rollers 220 and allows drop link 80 to move upwardly. Additionally, first arms 112 of cam 110 strike bight 92 of lever 90, thereby causing lever 90 to rotate in a counterclockwise direction about pin 206. As this occurs, drop link 80 is pulled upwardly, thereby rotating left toggle links 60 and right toggle link 70 counterclockwise and clockwise, respectively, and rotating drive link 50 in a counterclockwise direction so as to close the contacts of vacuum bottle 30.

To open switch 10, handle 120 is pulled downward in a direction so as to cause cam 110 to rotate in a clockwise direction, thereby applying force to head 103 in the manner described above. After a certain amount of force is stored in spring 101, second head 104 pivots rapidly in a counter-clockwise direction and cam 110 pivots rapidly in a clockwise direction. As this occurs, second arms 114 of cam 110 strike bight 92 of lever 90, thereby causing lever 90 to rotate in a clockwise direction. This forces drop link 80 downwardly, thereby forcing left toggle links 60 to rotate in a clockwise direction and right toggle link 70 to rotate in a counter-clockwise direction. This movement of the drive system causes drive link 50 to rotate in a clockwise direction, thereby pulling up on clevis 35 and opening the contacts of vacuum bottle 30. As second head 104 rotates in a counter-clockwise direction, it pushes latch 130 back in position abutting rollers 220, thereby holding the contacts in an open position.

Figure 7:
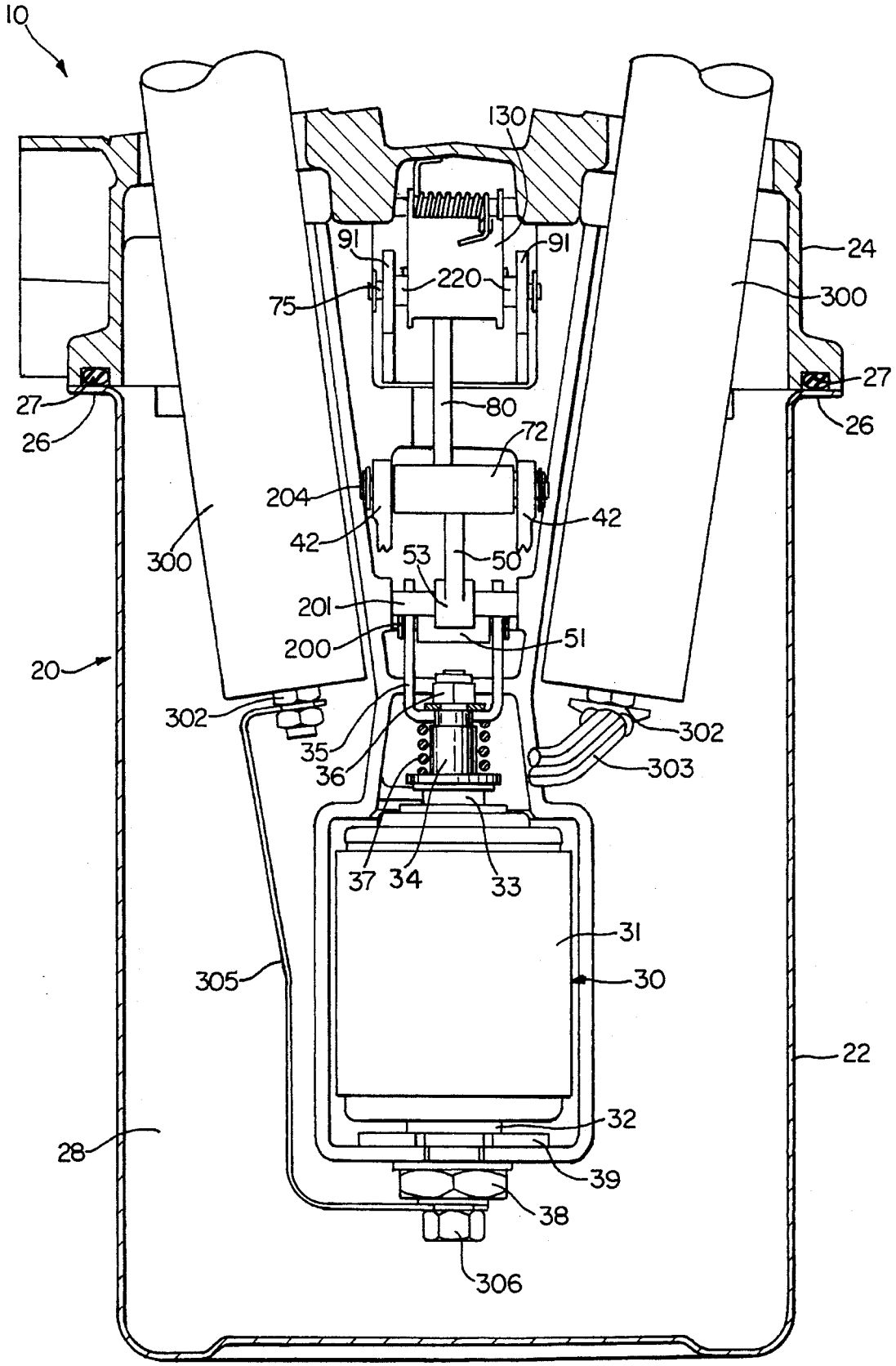
FIG. 7 is a cross-sectional view taken along line 7—7 in FIG. 1 and wherein bushings and terminals have been added to the switch.

FIG. 7 shows switch 10 with porcelain bushings 300 having terminals 302 extending therethrough. Note that the upper portions of bushings 300 and terminals 302 are not shown. However, terminals 302 extend above bushings 300 and are attached to medium voltage power lines. One terminal 302 is connected at its lower end to movable contact 33 by securing one end of a cable 303 to a terminal 302 and clamping a connector 304 on the other end of cable 303 beneath stud 34. Similarly, the lower portion of the second terminal 302 is electrically connected to stationary contact 32 by connecting one end of an electrically conductive strap 305 to a terminal 302 and clamping the other end of strap 305 to stationary contact 32 by screwing a bolt 306 into the threaded opening of stationary contact 32. Thus, when the contacts of vacuum bottle 30 are closed, current may pass through the first terminal 302, through vacuum bottle 30 and to the second terminal 302. Conversely, when the vacuum bottle contacts are opened, the circuit is broken.

Figure 8:
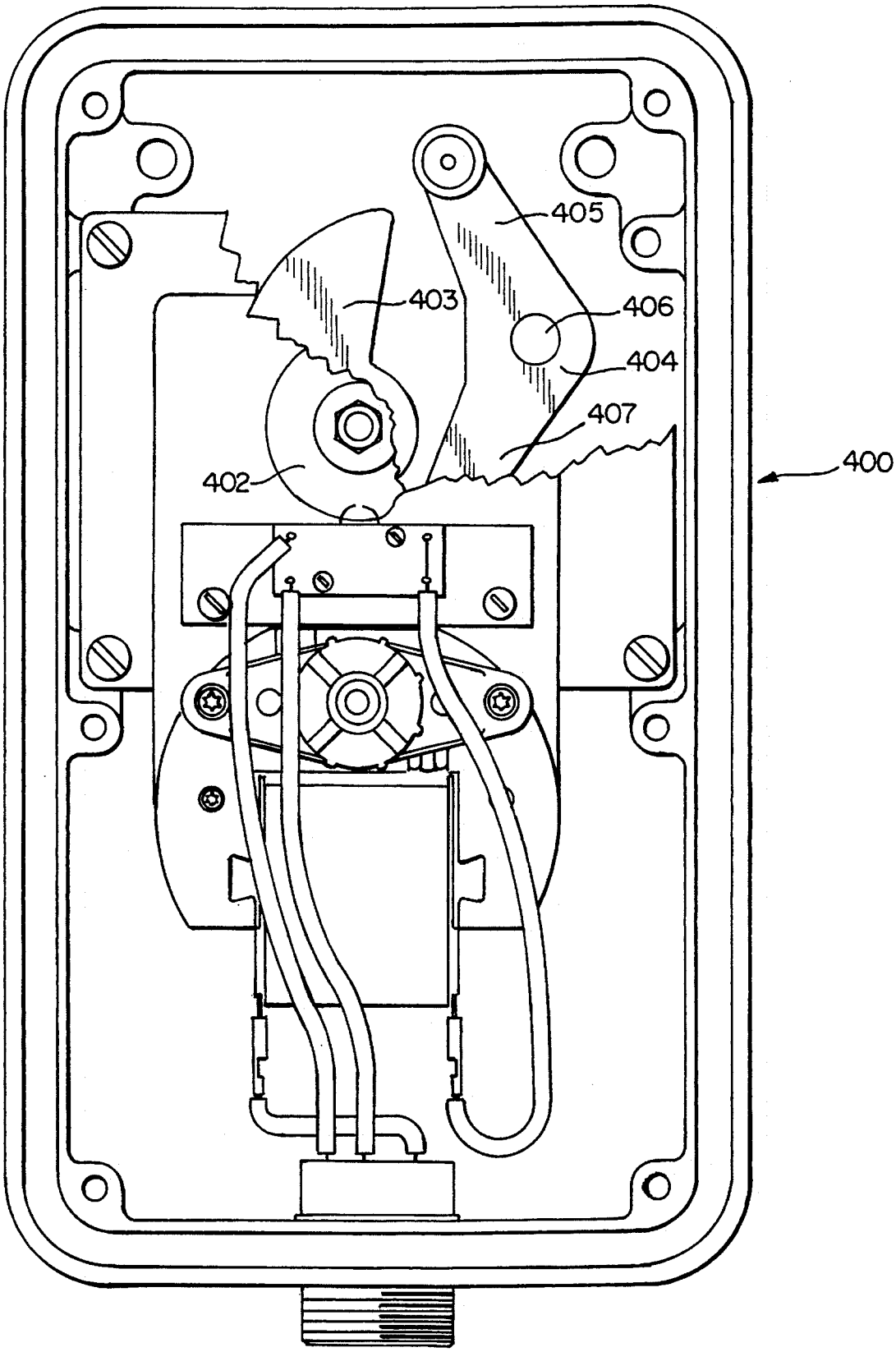
FIG. 8 is a partial cut-away view of a motor box that may be used to operate a vacuum switch according to the present invention.

FIG. 8 shows a motor box assembly 400 which may be used to operate switch 10. This assembly includes a drive means 402, a cam 403 and a crank 404. Crank 404 is pivotally secured about a pin 406, which is in turn coupled to pin 206 of switch 10 on the side of handle 120 opposite the side on which switch 10 is located. As power is supplied to motor box 400, drive mechanism 402 rotates, thereby causing rotation of cam 403. As cam 403 rotates, it strikes either arm 405 or arm 407 of crank 404, depending upon the orientation of crank 404. As cam 403 strikes crank 404, it causes crank 404 to rotate both itself and pin 406, which in turn causes rotation of pin 206 to open or close switch 10. Note that because motor box 400 does not directly drive switch 10, i.e., pin 206 is not directly coupled to drive mechanism 402, oil switch 10 may be both manually and electrically operated without the need to attach or remove handle 120 or motor box 400 depending on the desired mode of operation.

Although the invention has been described and illustrated in detail, it is to be clearly understood that the same is by way of illustration and example only and is not to be taken by way of limitation. Several variations may be made within the scope of the invention. For example, it is not necessary to include rollers 220 about pin 205. Latch 130 could directly abut pin 205. Also, latch 130 could abut drop link 80. Also, one of the left toggle links 60 could be eliminated. The spirit and scope of the invention are to be limited only by the terms of the appended claims.

What is claimed is:

1. A mechanism for opening and closing the contacts of a vacuum switch, comprising:

a drive link coupled to a movable contact of the vacuum bottle;

a first toggle link coupled to said drive link;

a drop link coupled to said first toggle link and to a lever;

a cam rotatably coupled to said lever for imparting motion to said lever;

a handle coupled to said cam for rotating said cam;

an over-center spring assembly coupled to said cam for resisting movement of the movable contact until a predetermined level of force is stored in said spring assembly;

a clevis attached to the movable contact; and a pin extending through the arms of said clevis and said drive link.

2. The mechanism according to claim 1, wherein said lever is generally U-shaped, said drop link is disposed within said lever and said lever and said drop link are coupled by a pin extending through said lever and said drop link.

3. The mechanism according to claim 1, wherein said cam and said lever are coupled by a pin.

4. The mechanism according to claim 1, further comprising a mounting tower disposed in said switch.

5. The mechanism according to claim 4, further comprising a second toggle link coupled to said drop link and to said mounting tower.

6. The mechanism according to claim 4, wherein said drive link is coupled to said mounting tower.

7. The mechanism according to claim 1, further comprising a torsion spring coupled to said drive link.

8. The mechanism according to claim 1, further comprising an over travel spring disposed beneath said clevis.

9. The mechanism according to claim 1, wherein said over-center spring assembly comprises:

a coil spring;

a shaft having a first end and a second end extending through said spring;

a first head fixed to said first end of said shaft; and a second head having a bore therein for slidably receiving said second end of said shaft.

10. The mechanism according to claim 9, wherein said first head is pivotally secured to said cam.

11. The mechanism according to claim 9, wherein said second head is pivotally secured to a cover of said switch.

12. A vacuum switch, comprising:

a vacuum bottle having one stationary contact and one movable contact; and a mechanism for opening and closing said contacts, said mechanism comprising a drive link coupled to said movable contact, a lever coupled to said drive link, a cam rotatably coupled to said lever by a pin and an over-center spring assembly coupled to said cam.

13. The switch according to claim 12, further comprising a mounting tower disposed in said switch.

14. The switch according to claim 13, further comprising a toggle link coupled to said mounting tower.

15. The switch according to claim 13, wherein said drive link is coupled to said mounting tower.

16. The switch according to claim 12, further comprising a torsion spring coupled to said drive link.

17. The switch according to claim 12, further comprising a clevis attached to said movable contact, a pin extending through the arms of said clevis and said drive link and an over travel spring disposed beneath said clevis.

18. A mechanism for opening and closing the contacts of a vacuum switch, comprising:

a drive link coupled to a movable contact of the vacuum bottle;

a first toggle link coupled to said drive link by a pin;

a drop link coupled to said first toggle link and to a lever;

a cam rotatably coupled to said lever for imparting motion to said lever;

a handle coupled to said cam for rotating said cam;

an over-center spring assembly coupled to said cam for resisting movement of the movable contact until a predetermined level of force is stored in said spring assembly;

a second toggle link coupled to said first toggle link; and a third toggle link coupled to said first toggle link and said drive link by said pin.

19. The mechanism according to claim 18, wherein said drop link and said first, second and third toggle links are coupled by a second pin.

20. A vacuum switch, comprising:

a vacuum bottle having one stationary contact and one movable contact; and a mechanism for opening and closing said contacts, said mechanism comprising a drive link coupled to said movable contact, a lever coupled to said drive link, a cam rotatably coupled to said lever; and an over-center spring assembly coupled to said cam, said over-center spring assembly comprising a coil spring, a shaft having a first end and a second end extending through said spring, a first head fixed to said first end of said shaft, and a second head having a bore therein for slidably receiving said second end of said shaft.

21. The switch according to claim 20, wherein said first head is pivotally secured to said cam.

22. The switch according to claim 20, wherein said second head is pivotally secured to the cover of said switch.

* * * * *